US007179369B2

(12) United States Patent
Dohnal et al.

(10) Patent No.: US 7,179,369 B2
(45) Date of Patent: Feb. 20, 2007

(54) OIL FILTER SYSTEM

(75) Inventors: Dieter Dohnal, Lappersdorf (DE); Karsten Viereck, Regenstauf (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 453 days.

(21) Appl. No.: 10/491,401

(22) PCT Filed: Jan. 23, 2003

(86) PCT No.: PCT/EP03/00636

§ 371 (c)(1),
(2), (4) Date: Mar. 31, 2004

(87) PCT Pub. No.: WO03/077267

PCT Pub. Date: Sep. 18, 2003

(65) Prior Publication Data

US 2004/0238419 A1 Dec. 2, 2004

(30) Foreign Application Priority Data

Mar. 8, 2002 (DE) ..... 102 10 396

(51) Int. Cl.
*H01F 27/14* (2006.01)

(52) U.S. Cl. ..... 210/87; 210/103; 210/137; 210/143; 210/258; 210/195.1

(58) Field of Classification Search ..... 417/20, 417/32, 43, 44.1–44.3; 210/143, 87, 90, 210/103, 258, 195.1, 137
See application file for complete search history.

(56) References Cited

U.S. PATENT DOCUMENTS 6,062,821 A * 5/2000 Golner et al. ..... 417/12

FOREIGN PATENT DOCUMENTS

| | | | |
|---|---|---|---|
| DE | 2948111 A | * | 6/1981 |
| DE | 4033172 C | * | 5/1992 |
| DE | 42 06 420 C2 | | 9/1992 |

* cited by examiner

*Primary Examiner*—Terry K. Cecil
(74) *Attorney, Agent, or Firm*—Andrew Wilford

(57) ABSTRACT

The invention relates to an oil filter installation for cleaning or cleaning and dessication of the oil in a tap changer at a power transformer or a plunger core coil, wherein a measuring device for detecting the volume flow of the through-flowing oil is provided and the electric pump motor is influenced by way of an interposed frequency converter in accordance with the result of a comparison of this measured value with a target value.

8 Claims, 2 Drawing Sheets

OIL FILTER SYSTEM

Figure 1:
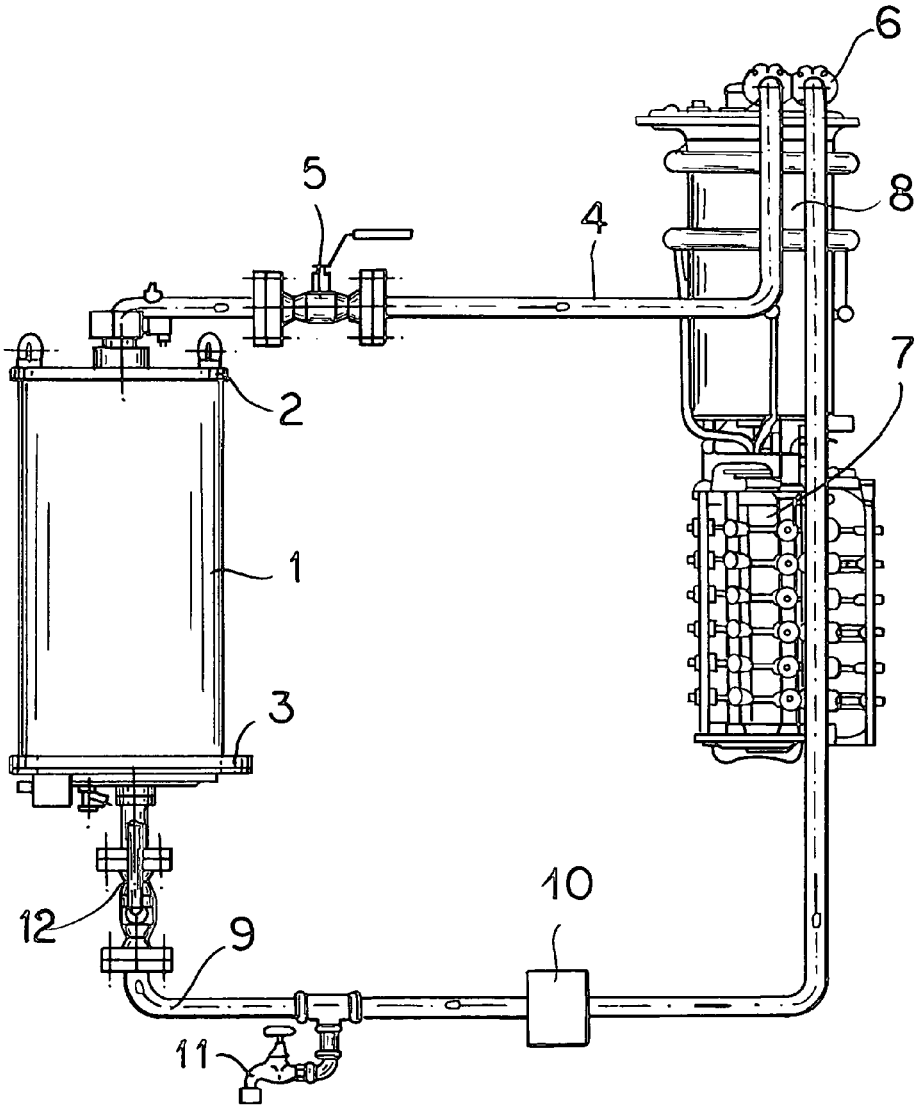

The invention relates to an oil filter system for cleaning or cleaning and desiccation of the oil in a tap changer at a power transformer or a plunger core coil.

Such an oil filter installation is already known from the Operating Instructions "Ölfilteranlage Typ 51" and "Ölfilteranlage OF 100" of the applicant.

Such a known oil filter system comprises a pump unit which contains, in a cylindrical vessel, a conveying pump, a pump motor and a filter cartridge. Flange connections for oil forward movement and oil return movement are mounted at the upper and lower cover of the vessel. The conveying pump inducts the switching oil by way of an intake line of the tap changer and by way of a pipe line for the forward movement. The oil in that case enters the vessel of the pump unit and is forced through the filter cartridge by the conveying pump. The oil cleaned by a paper filter cartridge or cleaned and dessicated by a combination filter cartridge leaves the vessel by way of a return connection and flows back by way of a pipe line for the return flow to the tap changer, more specifically the tap changer head.

A combination filter cartridge mentioned to be particularly suitable for such an oil filter installation is known from German Patent Specification 40 33 172.

This filter cartridge or also any filter cartridge of different construction clogs with filtered-out contaminating particles in the course of use and represents a constantly increasing flow resistance, the cartridge therefore needing to be changed at a defined operating pressure. For that purpose, specific monitoring devices are present in the known oil filter system: in the first instance there is provided a pressure switch which is set to the maximum permissible operating pressure and on reaching or exceeding this value closes a reporting contact which signals, for example in a switching interval, the attainment of the set maximum value and thus the necessity of exchange of the filter cartridge. In addition, there is usually provided a thermostat which suppresses reporting of this information of the pressure switch in the case of a low oil temperature of, for example, less than 20 degrees C. A false report when there is elevated oil viscosity is thereby avoided.

For control of the known oil filter system there is provided a time control which after actuation of the motor drive of the respective tap changer sets the pump motor and thus the conveying pump of the oil filter system into operation for a certain time. This is usually carried out by a time relay or a switching clock.

Finally, there is additionally provided for the pump motor as a safety device a motor protective switch with a thermal or magnetic excess-current trigger.

Considered in combination, the known oil filter systems thus have different disadvantages: with every switching on, the conveying pump runs at full power without the viscosity of the oil in dependence on oil temperature being taken into consideration. Since the conveying pump even at low oil temperatures and thus viscous oil has to generate a sufficiently high oil flow, the pump motor and conveying pump have to be over-dimensioned for normal operation. The consequence of that is, apart from possible cavitation in the conveying pump, a too-high oil flow in the intake line of the connected tap changer, which leads to a charge separation between the oil and the suction pipe in the load changeover switch thereof. As a further disadvantage, equally left out of consideration is the respective state of the filter cartridge, i.e. the degree of residual permeability thereof for the oil.

The object of the invention is accordingly to propose an oil filter system according to category which does not have these disadvantages and allows optimum oil filtration or oil filtration and oil dessication at any—temperature-dependent—oil viscosity and moreover takes into account the respective state of the filter cartridge within the permissible tolerance thereof for permeability in operation.

This object is met by an oil filter system with the features of the first claim. The subclaims relate to particularly advantageous developments of the invention.

The invention is based on the general idea of utilising a defined volume flow, measured in liters/second, of the oil, which is to be filtered, as a criterion for the functioning of the oil filter system. Thus, according to the invention this volume flow measurement is used for determination of the filtered oil quantity, for determination of the state of the filter cartridge and, in the result, for state-dependent control of the oil filter system. Such a volume flow measurement in accordance with the invention can preferably be carried out by a flow sensor with a defined cross section or also by means of a differential pressure measurement by way of a diaphragm arrangement.

A particular advantage of the invention consists in that compensation for a changing flow resistance as a consequence of a changing oil viscosity is provided by a change in the conveying performance of the conveying pump by way of an appropriate control part. A further advantage consists in that even a flow resistance, which increases in the course of the operating time of the filter cartridge, of this filter cartridge can be regulated out by increase in the conveying performance of the conveying pump. With the invention it is possible overall to always keep the volume flow quantity constant independently of the described influences, particularly even during the entire service life of the filter cartridge. Moreover, it is possible through a corresponding evaluation of the control signal to assess when a change of the filter cartridge is necessary.

A further advantage of the invention consists in that through appropriate possible selection or parameterisation of the target value for the volume flow the entire oil filter system can be adapted in simple manner to the most diverse tap changers which exist in numerous different forms of construction and constructional sizes with the most diverse oil volumes, pipe lengths and pipe cross-sections.

Figure 2:
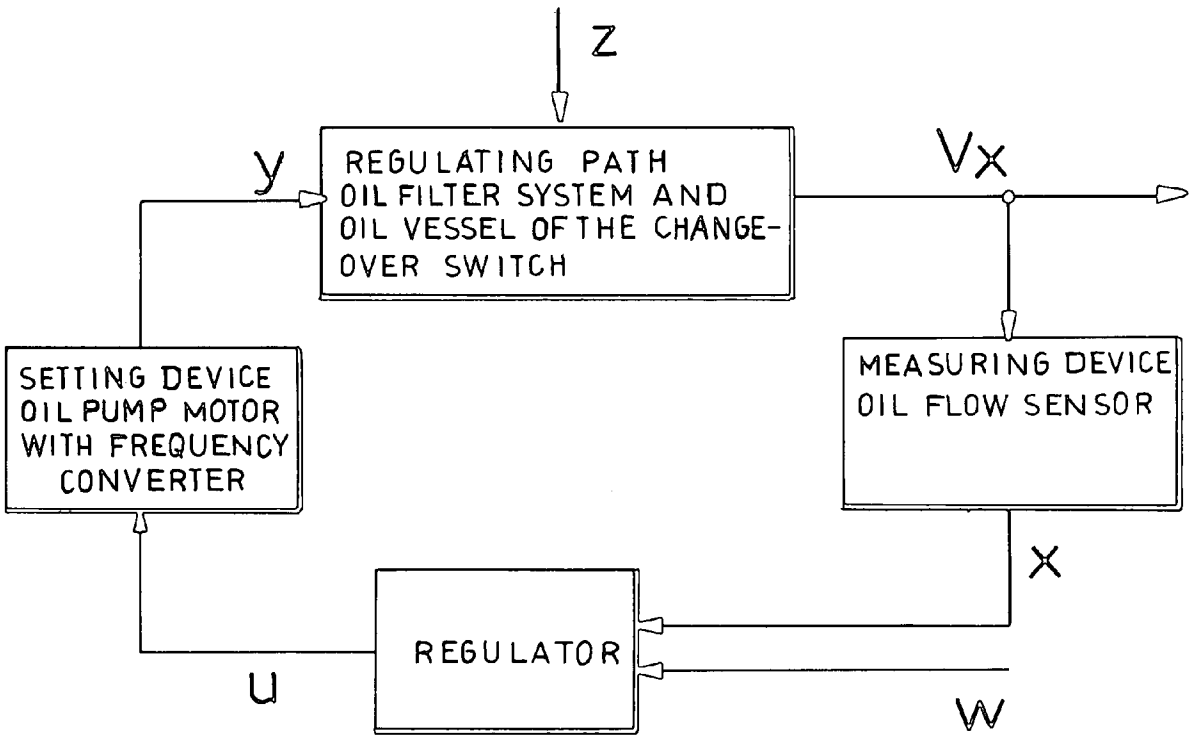

The invention will be explained in more detail by way of example in the following by reference to drawings, in which:

FIG. 1 shows an oil filter system according to the invention together with the connected tap changer, in schematic illustration, and FIG. 2 shows a regulating circuit for explanation of the method steps elapsing with the oil filter system according to the invention.

The illustrated oil filter system comprises a pump unit 1, in which, as known from the state of the art and not illustrated here, the conveying pump, the pump motor driving this and the filter cartridge are disposed. The pump unit 1 is in that case constructed as a cylindrical pressure vessel which is pressure-tightly closed by an upper cover 2 and a lower cover 3. Connected with the upper cover 2 is a return line 4 which has a stop cock 5 and leads to the tap changer head 6 of the connected tap changer 7. The filtered or filtered and dessicated oil is led back into the oil vessel 8 of the tap changer 7 through this return line 4. A further component of the oil circuit is a forward line 9 which in turn leads from the tap changer head 6 by way of an interposed oil flow sensor 10 according to the invention, a drain cock 11 and additionally a stop cock 12 back through the lower cover 3 into the interior of the pressure vessel and thus into the pump unit; the cooling circuit is thus closed.

The manner of function is as follows: The pump motor inducts the oil by way of a suction line of the tap changer 7 from the oil vessel 8 thereof via the forward line 9. In that case the oil flows through the oil flow sensor 10 arranged in the forward line 9. A volume flow measurement is carried out there. Suitable flow sensors for the oil flow sensor 10 are known and are available commercially. They operate as electronic flow sensors on the basis of the calorimetric principle and do not have any mechanically moved parts, so that mounting thereof can be carried out without consideration of position of installation and direction of flow thereagainst. Moreover, the underlying calorimetric principle is distinguished by its independence from the viscosity of the media. Electronic flow sensors according to the calorimetric principle in that case utilise the physical effect that a flowing medium takes up and transports away heat energy. Such a flow sensor is mounted in the pipe line by way of an appropriate connection and is disposed in contact with the flowing medium. Depending upon the property of the media and the specific requirements, the sensor is constructed in noble metal or a synthetic material and contains two temperature-dependent resistances and a heat source. Through the heat source there is generated in the medium a local temperature increase which is measured by one of the temperature-dependent resistances as measurement detector. If the medium is flowing, energy is withdrawn from the heat source; it is cooled. The temperature change resulting therefrom is a measure for the flow. The second measuring detector detects changes in the temperature of the medium and serves for compensation of the measurement result. The temperature-compensated measurement value is ultimately obtained from the resistance difference of the two temperature detectors. A further known sensor contains four temperature-dependent resistances, in which case the first two resistances which are flowed against when the medium is flowing are cooled; the detuning, which results therefrom, of a resistance bridge is a measure for the flow. A directionally independent flowing against the sensor is possible by the use of such a resistance bridge. Such flow sensors are available under the type designation SI 1004 from the company ifm electronic GmbH, of Germany. Quite similar flow sensors are also available from the companies Weber Sensors, United States, Endress & Hauser, Germany, and Schmidt-Feintechnik, Germany.

The oil enters the pressure vessel from below via the cover 3 and is forced by the conveying pump through the filter insert. The cleaned oil then leaves the pressure vessel at the upper cover 2 and flows back by way of the return line 4 to the oil vessel 8 of the tap changer 7.

According to the invention the pump motor has, in the pump unit 1, means for control of its rotational speed; a frequency converter is particularly suitable for this purpose.

The principle of rotational speed regulation of three-phase synchronous motors by frequency control is known to the expert; if it is desired to regulate the rotational speed of such a motor by way of the frequency, devices have to be used which can convert the fixed mains voltage frequency into variable frequencies. This can be carried out by frequency converters which contain various electrical components, for example thyristors, transistors, IGBTs or MCTs. Any frequency which is greater or smaller than that of the mains voltage can be produced by means of such a frequency converter. A suitable frequency converter is produced under the designation "MICROMASTER" by the company Siemens. The same manufacturer also already offers under the designation COMBIMASTER (Registered Trade Mark) a combination of a frequency converter and an asynchronous motor as a common subassembly.

The conveying performance of the conveying pump is, as a consequence, also variable by the possible rotational speed control of the pump motor. Known centrifugal pumps are, in particular, usable as conveying pumps; other kinds of pumps known to the expert are also usable.

The oil flow sensor 10 arranged in the forward line 9 leading to the pump unit 1 detects, in the above-explained manner, the volume flow of the oil through the forward line 9 and thus also through the oil vessel 8 of the load changeover switch of the tap changer 7. The oil flow sensor 10 is electrically connected with a regulator (not illustrated) in which a comparison of the actually measured volume flow, i.e. the oil flow, with a predetermined target value takes place and, in the case of deviation, the rotational speed of the pump motor and thus the conveying performance of the conveying pump are correspondingly varied by means of the frequency converter connected upstream of the pump motor.

A change in the oil flow, which is detected by the oil flow sensor 10 and leads to a change in the conveying performance, can, as already explained further above, have different causes. On the one hand, the viscosity of the oil can change due to changing temperature conditions and on the other hand the flow resistance of a filter insert, which is increasingly clogged in operation with filtered-out particles, can constantly increase. The two causes are equally detected by the invention and lead to a change in the conveying performance, i.e. a regulation out. In all cases the oil flow speed in the forward line 9 is kept to a constant, non-critical value.

In particularly advantageous manner it is additionally possible to employ the control signal, which is produced in the regulator as a consequence of comparison of target value and actual value of the flow speed, for monitoring the entire system with respect to occurring maximum or minimum values. In addition, through a time-related storage of this signal an impending change of the filter cartridge can be planned in the long term as a prediction.

It is also possible on attainment of the respective limit value and without further measures to produce a signal "change filter" and to display it in, for example, a switching interval or at a control panel.

Moreover, it is possible to provide additional means for monitoring the $H_2O$ content in the oil in that, for example, an additional $H_2O$ sensor is arranged in the forward line. The moisture content of the oil can be determined by such an additional $H_2O$ sensor, which is familiar to the expert; through comparison of the detected moisture content in turn with a previously predetermined limit value it can be ascertained when in the case of combination filters, i.e. filter cartridges not only for cleaning, but also for desiccation, the zeolite insert producing the desiccation of is saturated and for this reason—independently of the state of the other filter layers by which the oil flow is influenced—an exchange of the filter cartridge should be carried out.

The regulating method on which the invention is based shall be explained again on the basis of FIG. 2, in which the schematic regulating circuit is illustrated. In the block diagram there is shown at the top the regulating path which consists of the oil filter system itself in accordance with the invention and the oil vessel 8 of the tap changer 7, which is connected with this. A contamination of the filter insert or also a temperature-caused change in viscosity of the oil act on this regulating path as disturbance magnitudes Z. The volume flow Vx of the oil is detected in a measuring device, here the oil flow sensor 10, as a regulating magnitude and is converted into a measurement signal x. This measurement signal x, representing the actual value of the volume flow Vx, is compared in a regulator with a corresponding target value w. A suitable regulator can be constructed in the most diverse ways; here, for example, an apparatus "Tap Manager" (Registered Trade Mark) of the applicant can be used with particular advantage. In the result, a control magnitude u is produced by the regulator, this being in concrete form a variable drive control current for a frequency converter at the pump motor of the conveying pump. This pump motor can thereby change its rotational speed; as a consequence, the performance of the conveying pump varies and thus regulates out the influence of the disturbance magnitudes Z. The regulating circuit is thus closed. It is further possible through an appropriate selection of the predetermined target value w, i.e. the desired oil flow speed, to adapt the entire oil filter system in simple manner to different conditions at different tap changers. In particular, different lengths and cross-sections of the forward and return lines 9, 4, the oil volume in the respective oil vessel 8 of the tap changer 7 or also defined specific types of oil can be taken into consideration. Beyond that it is also possible to file the control magnitudes, which are produced by the regulator, in a non-volatile store over a longer period of time and to obtain therefrom predictions about the state of the entire installation in general and the respective filter insert and anticipated exchange time thereof in particular.

The invention claimed is:

1. Oil filter system for cleaning or cleaning and desiccation of the oil in a tap changer at a power transformer or a plunger core coil, wherein a pump unit constructed as a pressure vessel is provided, wherein the pump unit comprises a conveying pump, a pump motor driving the conveying pump and a filter cartridge, and wherein an oil circuit is formed between the pressure vessel and tap changer by a return line for transport to the tap changer of the oil that has flowed through the filter cartridge and a forward line for transport to the filter cartridge of the oil that is to be cleaned, characterised in that a measuring device for detection of the volume flow of the throughflowing oil and conversion into an electrical measurement signal is provided, that the measuring device is connected with a regulator in which a setting signal can be produced as a result of a comparison of the electrical measuring signal with a preset target value, that the regulator is electrically connected with the input of a frequency converter and that the output of the frequency converter is electrically connected with the electrical terminals of the pump motor.

2. Oil filter system according to claim 1, characterised in that the measuring device for detection of the volume flow is a calorimetric flow sensor (10).

3. Oil filter system according to claim 1, characterised in that the measuring device for detection of the volume flow is a differential pressure measuring device with a diaphragm arrangement.

4. Oil filter system according to claim 1, characterised in that a further measuring device for detection of the $H_2O$ content of the throughflowing oil and conversion into a further electrical signal is provided in the forward line (9) or in the return line (4).

5. Oil system according to claim 4, characterised in that further means are provided for producing a signal for filter change if the detected $H_2O$ reaches a previously set maximum value.

6. Oil filter system according to claim 1, characterised in that additional means for time-related storage of the detected values of the volume flow and/or for detection of the minimum/maximum value thereof are provided.

7. Oil filter system according to claim 1, characterised in that means are provided for producing a signal for filter change if the detected volume flow reaches the minimum value.

8. Oil filter system according to claim 1, characterised in that the preset target value of the volume flow is selectable in dependence on the mode of construction of the tap changer and/or the dimensioning of the return line (4) and the forward line (9).

* * * * *